US008529286B2

(12) United States Patent
Su et al.

(10) Patent No.: US 8,529,286 B2
(45) Date of Patent: Sep. 10, 2013

(54) DETACHMENT AND DISPLACEMENT PROTECTION STRUCTURE FOR INSERTION OF FLEXIBLE CIRCUIT FLAT CABLE

(75) Inventors: Kuo-Fu Su, Taoyuan County (TW); Gwun-Jin Lin, Taoyuan County (TW)

(73) Assignee: Advanced Flexible Circuits Co., Ltd., Taoyuan County (TW)

( * ) Notice: Subject to any disclaimer, the term of this patent is extended or adjusted under 35 U.S.C. 154(b) by 4 days.

(21) Appl. No.: 13/309,826

(22) Filed: Dec. 2, 2011

(65) Prior Publication Data

US 2012/0149235 A1 Jun. 14, 2012

(30) Foreign Application Priority Data

Dec. 14, 2010 (TW) ..... 99143803 A

(51) Int. Cl.
*H01R 12/24* (2006.01)

(52) U.S. Cl.
USPC ..... 439/495

(58) Field of Classification Search
USPC ..... 439/492–499
See application file for complete search history.

(56) References Cited

U.S. PATENT DOCUMENTS

| | | | | |
|---|---|---|---|---|
| 6,089,905 | A * | 7/2000 | Shimmyo et al. | 439/495 |
| 7,048,573 | B2 | 5/2006 | Masaki et al. | |
| 7,223,120 | B2 * | 5/2007 | Ko | 439/492 |
| 7,435,131 | B1 * | 10/2008 | Lee | 439/495 |
| 7,467,970 | B2 * | 12/2008 | Ikuta et al. | 439/496 |
| 7,530,839 | B1 * | 5/2009 | Lee | 439/496 |
| 7,540,764 | B2 * | 6/2009 | Suzuki et al. | 439/495 |
| 7,625,231 | B2 * | 12/2009 | Takahira | 439/495 |
| 7,628,618 | B2 * | 12/2009 | Wang et al. | 439/67 |
| 7,674,134 | B2 * | 3/2010 | Yamaji et al. | 439/607.53 |
| 7,682,184 | B2 * | 3/2010 | Ko et al. | 439/495 |
| 7,713,080 | B1 * | 5/2010 | Wahlberg | 439/329 |
| 7,736,164 | B2 * | 6/2010 | Okamura | 439/260 |
| 7,862,361 | B2 * | 1/2011 | Wahlberg | 439/329 |
| 7,887,351 | B2 * | 2/2011 | Wang et al. | 439/260 |
| 7,988,465 | B2 * | 8/2011 | Chuo et al. | 439/98 |
| 8,083,541 | B2 * | 12/2011 | Yeh | 439/492 |
| 8,083,542 | B2 * | 12/2011 | Kodaira | 439/497 |
| 8,241,065 | B2 * | 8/2012 | Ikari et al. | 439/607.41 |

(Continued)

FOREIGN PATENT DOCUMENTS

TW I245466 B 12/2005

OTHER PUBLICATIONS

Communication From the Taiwan Patent Office Regarding a Counterpart Foreign Application Dated Feb. 19, 2013 (Taiwan Year 102).

*Primary Examiner* — Ross Gushi
(74) *Attorney, Agent, or Firm* — Rosenberg, Klein & Lee

(57) ABSTRACT

Disclosed is a detachment and displacement protection structure for insertion of flexible circuit flat cable. An inserter positioning section is formed on a flexible circuit flat cable and coupled with an inserter, which includes a metal member and a plastic member. In assembling, the plastic member is first positioned on a first surface of the inserter positioning section of the flexible circuit flat cable, and then the metal member is fit over the plastic member. A detachment and displacement protection structure is provided on the inserter positioning section to constrain the inserter from displacing and detaching in a flat cable extension direction due to being acted upon by an external force when the inserter is positioned on the inserter positioning section.

2 Claims, 7 Drawing Sheets

(56) References Cited

U.S. PATENT DOCUMENTS

| | | | | |
|---|---|---|---|---|
| 8,242,374 | B2 * | 8/2012 | Chuo et al. | 174/254 |
| 8,292,648 | B2 * | 10/2012 | Kiryu et al. | 439/328 |
| 8,313,342 | B2 * | 11/2012 | Lin et al. | 439/492 |
| 2005/0106931 | A1 * | 5/2005 | Yagi et al. | 439/495 |
| 2005/0233632 | A1 * | 10/2005 | Hsu et al. | 439/495 |
| 2005/0255742 | A1 * | 11/2005 | Shih | 439/492 |
| 2006/0134969 | A1 * | 6/2006 | Takaku et al. | 439/495 |
| 2008/0146075 | A1 * | 6/2008 | Mundt | 439/492 |
| 2008/0200062 | A1 * | 8/2008 | Huang et al. | 439/494 |
| 2008/0214044 | A1 * | 9/2008 | Ko et al. | 439/499 |
| 2008/0305678 | A1 * | 12/2008 | Chiang | 439/492 |
| 2009/0004910 | A1 * | 1/2009 | Takahira | 439/495 |
| 2009/0023324 | A1 * | 1/2009 | Koike et al. | 439/345 |
| 2009/0088012 | A1 * | 4/2009 | Oooka | 439/260 |
| 2009/0137146 | A1 * | 5/2009 | Wang et al. | 439/499 |
| 2009/0137147 | A1 * | 5/2009 | Yang et al. | 439/499 |
| 2009/0176403 | A1 * | 7/2009 | Yang et al. | 439/495 |
| 2010/0087087 | A1 * | 4/2010 | Yeh | 439/493 |
| 2011/0104938 | A1 * | 5/2011 | Suzuki | 439/493 |
| 2011/0130030 | A1 * | 6/2011 | Morita | 439/499 |
| 2012/0142218 | A1 * | 6/2012 | Lin et al. | 439/607.49 |
| 2012/0149235 | A1 * | 6/2012 | Su et al. | 439/492 |

* cited by examiner

DETACHMENT AND DISPLACEMENT PROTECTION STRUCTURE FOR INSERTION OF FLEXIBLE CIRCUIT FLAT CABLE

BACKGROUND OF THE INVENTION

1. Field of the Invention

The present invention relates to an insertion structure of flexible flat cable, and in particular to a flexible circuit flat cable having a detachment and displacement protection structure for insertion, which allows an inserter, when positioned in an inserter positioning zone defined in a flexible circuit flat cable, to be protected against detachment and displacement caused by being acted upon by an external force.

2. The Related Arts

A flexible flat cable is commonly used in various electronic products, such as notebook computers, personal digital assistants, and mobile phones. A conventional structure of flexible flat cable is such that a plurality of conductors that are each enclosed by an insulation layer is juxtaposed to form a flat cable structure, which is combined with connectors or circuit soldering for realizing transmission of electronic signals.

The flexible circuit flat cable has the general features of small thickness and flexibility and thus, when a flexible circuit flat cable is inserted into a corresponding slot, it is quite often that the insertion is not firm and stability is poor. To cope with such a problem, some manufacturers attempt to provide an inserter at a leading end of a flexible circuit flat cable to improve mechanical stability and also improve the stability of electrical engagement for the insertion. The inserter generally comprises a metal member and a plastic member.

In assembling, the metal member is first fit to a flexible circuit flat cable and the plastic member is set on a predetermined zone on the flexible circuit flat cable. And then, the metal member is moved frontward to fit over the plastic member. Under this condition, the flexible circuit flat cable can be inserted into a slot with the insertion section thereof.

However, conventionally, no detachment and displacement protection structure is provided and when a user pushes the metal member rearward with a hand, the inserter may be separated from the plastic member in the direction of extension of the flat cable. The plastic member is no longer enclosed by and coupled with the metal member so that the plastic member cannot be properly positioned on the predetermined zone of the flexible circuit flat cable. As such, the function that is supposed to be obtained by the disposition of the metal member and the plastic member is completely lost and it is no longer possible to improve the mechanical stability and the electrical contact stability for the insertion as originally desired.

SUMMARY OF THE INVENTION

Thus, an objective of the present invention is to provide a detachment and displacement protection structure for insertion of flexible circuit flat cable, which allows an inserter, when coupled to a flexible circuit flat cable, to be protected against detachment and displacement from an originally-set predetermined zone of the flexible circuit flat cable due to a force applied by the operation of a user.

To achieve the objective, the present invention provides a detachment and displacement protection structure for insertion of flexible circuit flat cable. An inserter positioning section is formed on a flexible circuit flat cable and coupled with an inserter, which comprises a metal member and a plastic member. In assembling, the plastic member is first positioned on a first surface of the inserter positioning section of the flexible circuit flat cable, and then the metal member is fit over the plastic member. A detachment and displacement protection structure is provided on the inserter positioning section to constrain the inserter from displacing and detaching in a flat cable extension direction due to being acted upon by an external force when the inserter is positioned on the inserter positioning section.

The efficacy of the present invention is that the present invention provides a structure of inserter of flexible circuit flat cable that realizes stable and secure insertion function. The present invention allows the inserter, once properly coupled to and positioned on a predetermined zone of the flexible circuit flat cable, to resist against detachment and displacement from the original location even being acted upon by an external force, thereby increasing mechanical stability and improving electrical contact stability for insertion.

BRIEF DESCRIPTION OF THE DRAWINGS

The present invention will be apparent to those skilled in the art by reading the following description of preferred embodiments of the present invention, with reference to the attached drawings, in which.

DETAILED DESCRIPTION OF THE PREFERRED EMBODIMENTS

Figure 1:
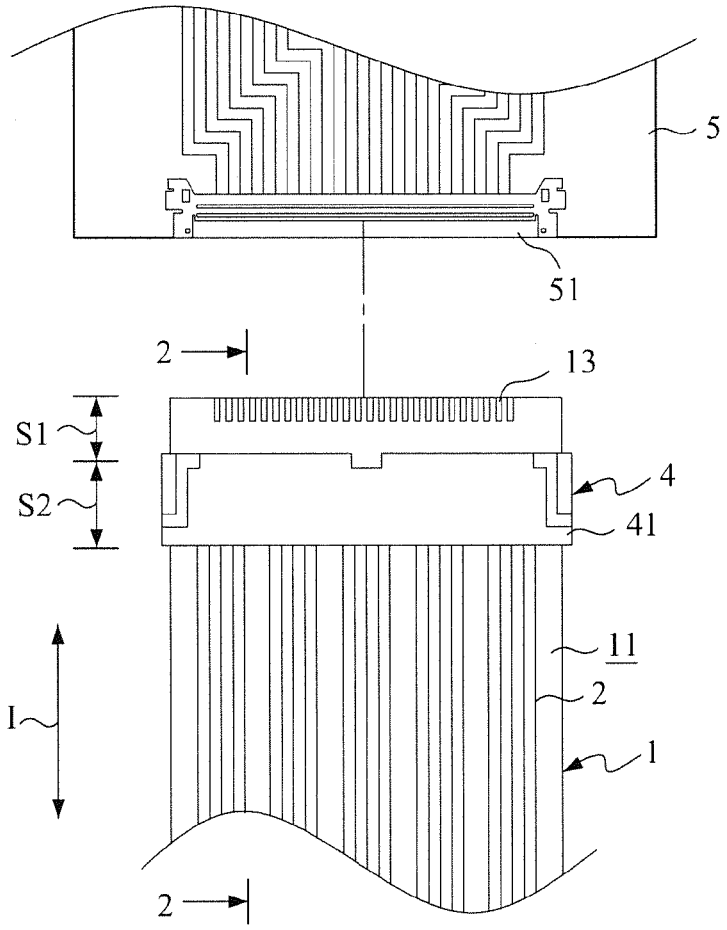
FIG. 1 is a schematic view illustrating a first embodiment of the present invention.
Figure 2:
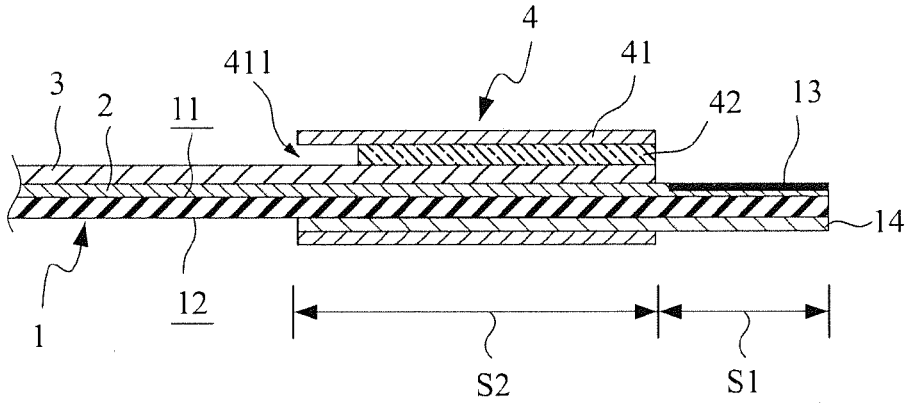
FIG. 2 is a cross-sectional view taken along line 2-2 of FIG. 1.

With reference to the drawings and in particular to FIGS. 1 and 2, which are schematic views showing a first embodiment of the present invention, a flexible circuit flat cable 1 has a first surface 11 and a second surface 12. The flexible circuit flat cable 1 extends in a flat cable extension direction I and forms an insertion section S1 at a free end of the flexible circuit flat cable 1. An area adjacent to the insertion section S1 is defined as an inserter positioning section S2.

The flexible circuit flat cable 1 is provided, on the first surface 11, with a plurality of conductive traces 2 parallel to and spaced from each other. Each of the conductive traces 2, after extending through the inserter positioning section S2, reaches the insertion section S1 of the flexible circuit flat cable 1 so as to form a plurality of the conductive terminals 13 on the insertion section S1.

An insulation cover layer 3 is formed on the first surface 11 and the conductive traces 2 of the flexible circuit flat cable 1. An inserter 4 is positioned on the inserter positioning section S2. The inserter 4 is composed of a metal member 41 and a plastic member 42, wherein the metal member 41 forms a predetermined hollow section 411 and the plastic member 42 has a plate like configuration.

Figure 3:
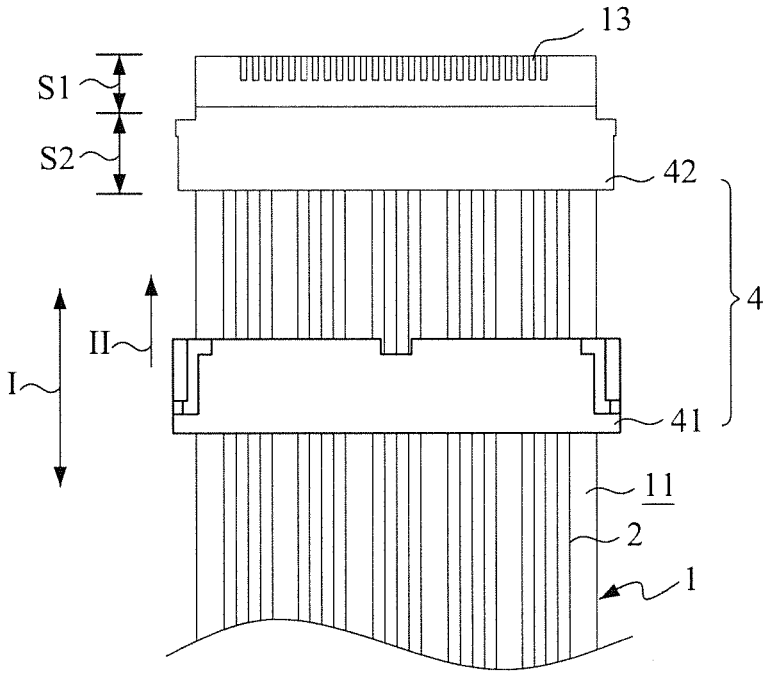
FIG. 3 is a front-side schematic view illustrating a condition where a metal member and a plastic member of the first embodiment of the present invention are arranged on a flexible circuit flat cable but not assembled together.
Figure 4:
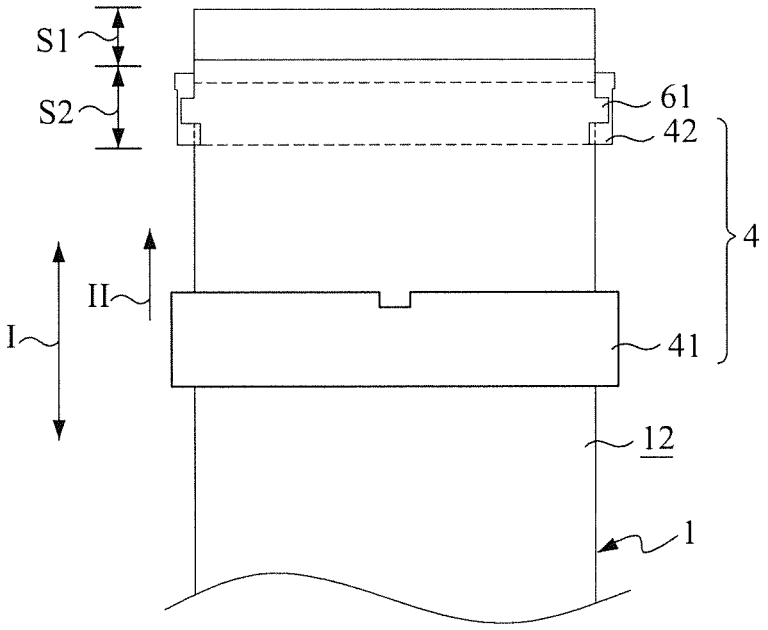
FIG. 4 is a rear-side schematic view illustrating the condition where the metal member and the plastic member of the first embodiment of the present invention are arranged on the flexible circuit flat cable but not assembled together.
Figure 5:
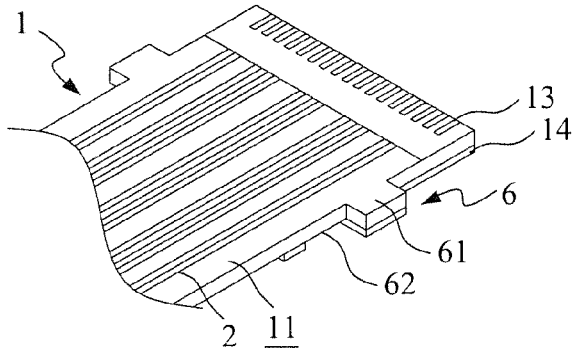
FIG. 5 is a front-side perspective view illustrating the flexible circuit flat cable of the first embodiment of the present invention.
Figure 6:
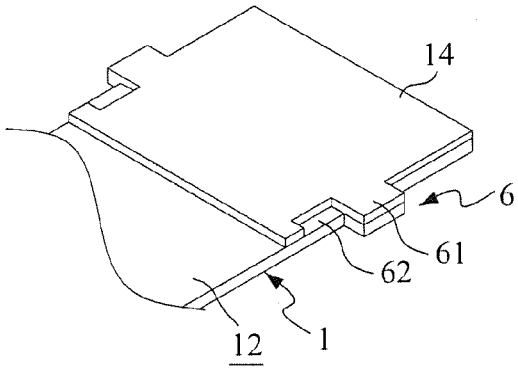
FIG. 6 is a rear-side perspective view illustrating the flexible circuit flat cable of the first embodiment of the present invention.
Figure 7:
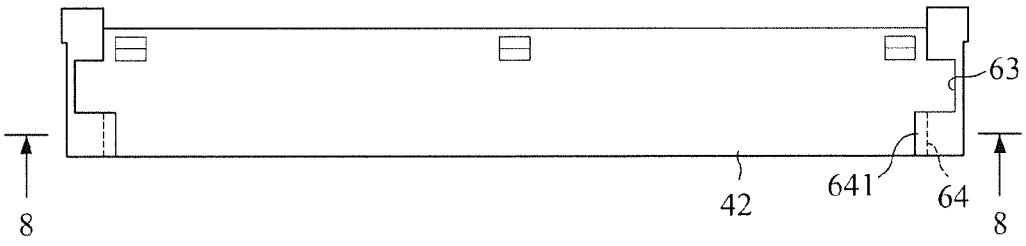
FIG. 7 is a top plan view illustrating the plastic member of the first embodiment of the present invention.
Figure 8:
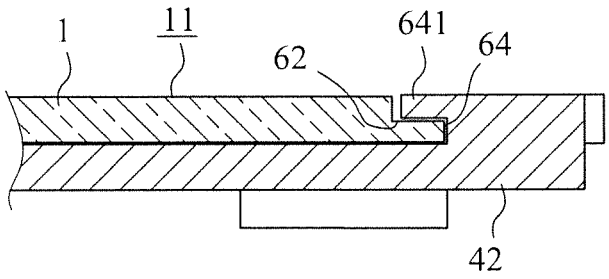
FIG. 8 is a cross-sectional view showing the plastic member assembled to the flexible circuit flat cable according to the first embodiment of the present invention.

Referring to FIGS. 2-4, in assembling, the conductive terminals 13 of the flexible circuit flat cable 1 are first inserted through a hollow section 411 (see FIG. 2) formed in a rear end of the metal member 41 of the inserter 4, and then, the plastic member 42 is positioned on the first surface 11 of the flexible circuit flat cable 1 at a location corresponding to the inserter positioning section S2. Afterwards, the metal member 41 is moved frontward in a slide direction II to fit over and enclose and couple to the plastic member 42.

After the above described assembling operation, the insertion section S1 of the flexible circuit flat cable 1 may then be inserted into a slot 51 mounted on a circuit board 5 to have the conductive terminals 13 of the insertion section S1 of the flexible circuit flat cable 1 respectively contacting and engaging corresponding conductive terminals of the slot 51.

Referring to FIGS. 5-8, the flexible circuit flat cable 1 is provided with a detachment and displacement protection structure 6 in the inserter positioning section S2. In the first embodiment of the present invention, the detachment and displacement protection structure 6 comprises a pair of projecting lug sections 61, which project sideways beyond opposite side edges of the inserter positioning section S2 of the flexible circuit flat cable 1, and recesses 62 are formed in the side edges of the flexible circuit flat cable 1 respectively at locations adjacent to the projecting lug sections 61. In a preferred embodiment, a shielding layer 14 made of a conductive material is formed on the second surface 12 of the flexible circuit flat cable 1, and portions of the shielding layer 14 that are adjacent to the projecting lug sections 61 are hollowed to form the recesses 62. Besides being made of a conductive material, the shielding layer 14 can also be made of an insulation material to serve as a strength-reinforcing layer. The recesses 62 may be alternatively be hollow zones formed in the side edges of the flexible circuit flat cable 1.

As to the inserter 4, the plastic member 42 forms a retention section 63 at a location corresponding to each of the projecting lug sections 61 of the flexible circuit flat cable 1 and also forms a retention slot 64 adjacent to the retention section 63. The retention slot 64 is delimited by a wing plate 641 formed on the plastic member 42.

When the plastic member 42 is coupled to the inserter positioning section S2 of the flexible circuit flat cable 1, the retention sections 63 of the plastic member 42 of the inserter 4 are exactly and respectively fit over the projecting lug sections 61 of the flexible circuit flat cable 1, and the retention slots 64 of the plastic member 42 are respectively fit over the recesses 62 of the flexible circuit flat cable 1. As such, when being acted upon by an external force, the inserter 4 does not displace and detach in the flat cable extension direction I, nor displacing and detaching in a direction perpendicular to the flat cable extension direction I.

Figure 9:
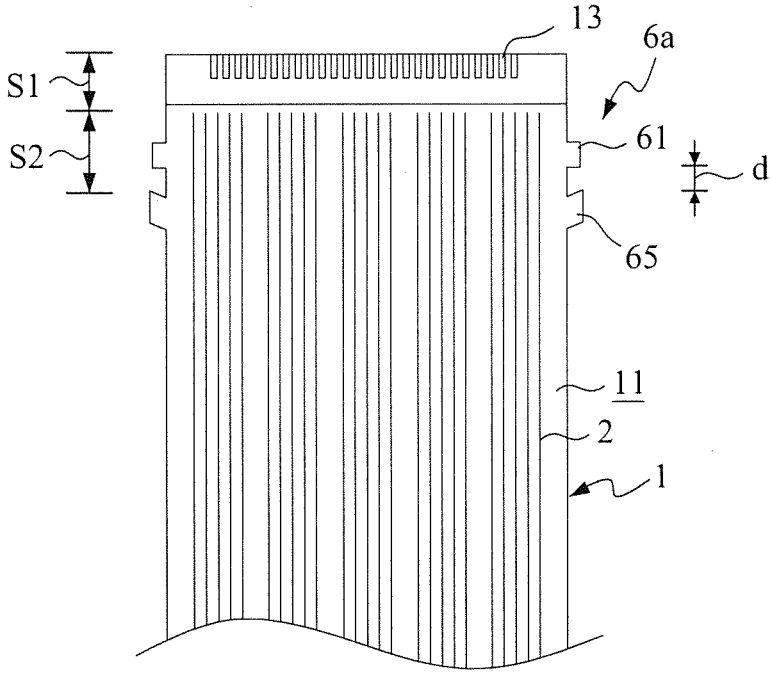
FIG. 9 is a schematic view illustrating a flexible circuit flat cable according to a second embodiment of the present invention.
Figure 10:
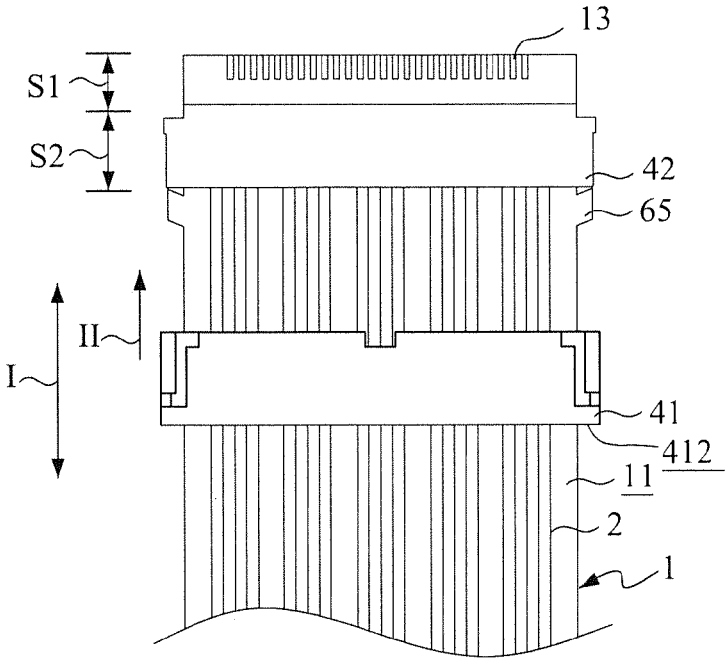
FIG. 10 is a front-side schematic view illustrating a condition where a metal member and a plastic member of the second embodiment of the present invention are arranged on the flexible circuit flat cable but not assembled together.
Figure 11:
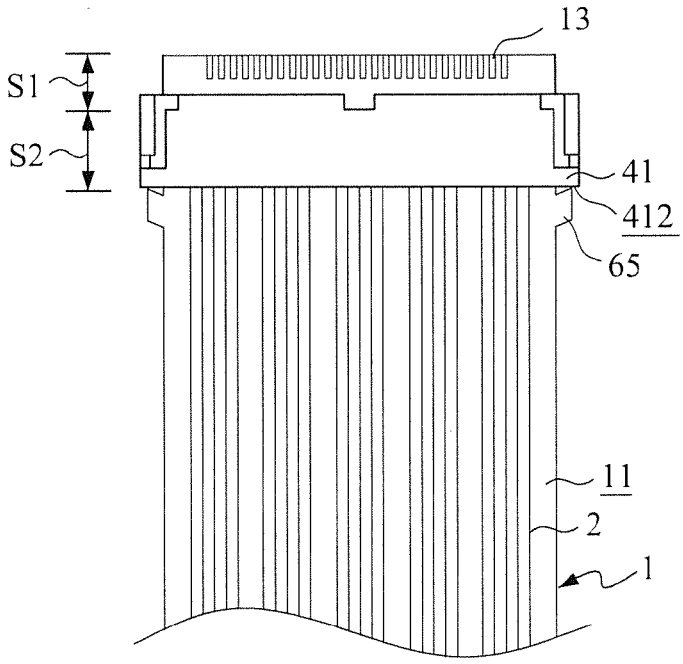
FIG. 11 is a front-side schematic view illustrating a condition where the metal member and the plastic member of the second embodiment of the present invention are arranged on the flexible circuit flat cable and are assembled together.

Referring to FIGS. 9-11, a second embodiment of the present invention is schematically illustrated. In the instant embodiment, elements/components similar to those of the previously embodiment are designated with identical reference numerals for consistency and correspondence. In the instant embodiment, a detachment and displacement protection structure 6*a* comprises a pair of projecting lug sections 61, which projects sideways beyond opposite side edges of the inserter positioning section S2 of the flexible circuit flat cable 1, and a pair of projecting wing sections 65 are respectively formed on the side edges of the flexible circuit flat cable 1 at locations adjacent to the projecting lug sections 61, with a predetermined distance d formed therebetween. The plastic member 42 of the inserter 4 forms retention sections 63 at locations corresponding to the projecting lug sections 61 of the flexible circuit flat cable 1.

When the plastic member 42 is coupled to the inserter positioning section S2 of the flexible circuit flat cable 1, the retention section 63 of the plastic member 42 of the inserter 4 are exactly and respectively fit over the projecting lug sections 61 of the flexible circuit flat cable 1. When the metal member 41 of the inserter 4 is fit over and coupled to the plastic member 42, a rear end face 412 of the metal member 41 is set in contact engagement with the projecting wing sections 65 so as to constrain any displacement of the metal member 41.

Figure 12:
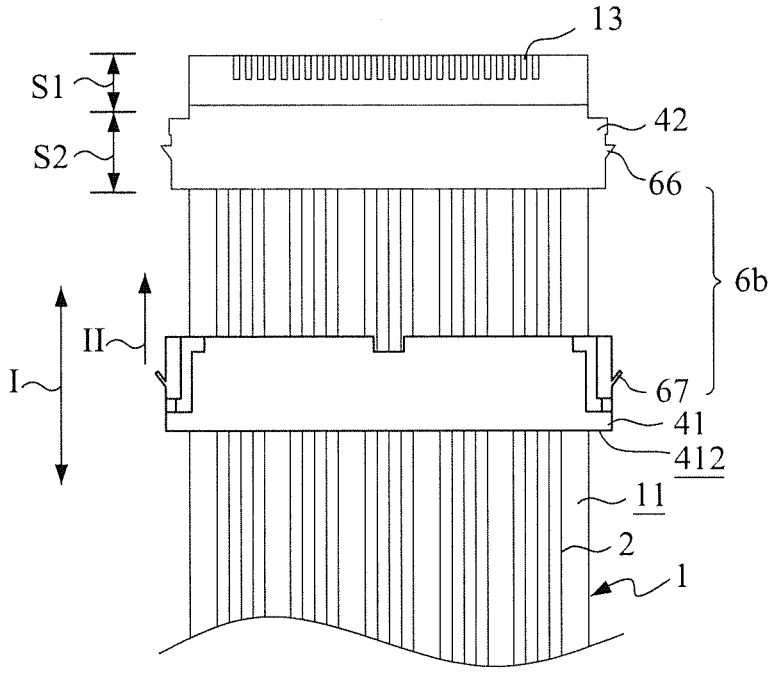
FIG. 12 is a schematic view illustrating a third embodiment of the present invention.
Figure 13:
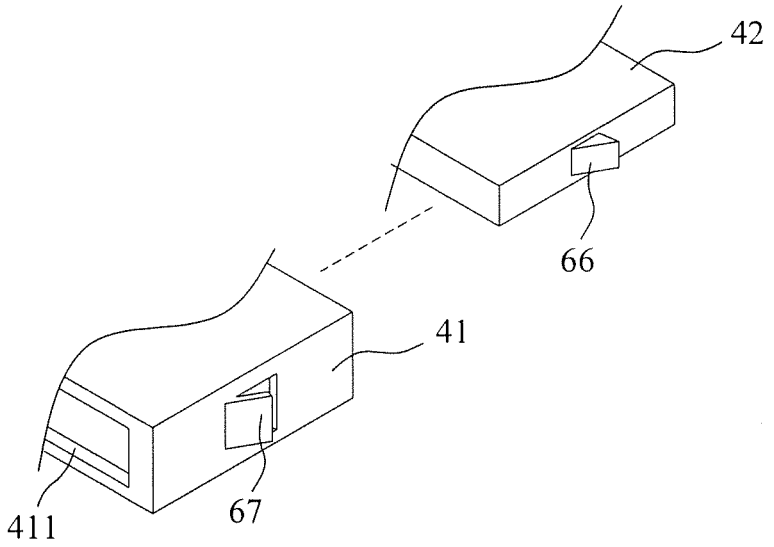
FIG. 13 is a schematic view illustrating a plastic member forming a locking section and a metal member forming a counterpart locking section according to the third embodiment of the present invention.

Referring to FIGS. 12 and 13, a third embodiment of the present invention is schematically illustrated. In the instant embodiment, a detachment and displacement protection structure 6*b* comprises at least one locking section 66 formed on a side edge of the plastic member 42 and a counterpart locking section 67 formed on a side edge of the metal member 41 at a corresponding location. When the metal member 41 is fit over and encloses the plastic member 42, the counterpart locking section 67 of the metal member 41 engages and fixes the locking section 66 of the plastic member 42. In the drawings, the locking section 66 is of a triangular configuration, but it can be of other configurations, such as a circular projection, and the counterpart locking section 67 of the metal member 41 is of a configuration corresponding to the locking section 66. The locking section 66 can be made of plastic as a unitary structure and the counterpart locking section 67 can be made with a regular metal stamping operation. They are considered within the scope of the present invention if they are of configurations that are corresponding and engageable with each other.

Figure 14:
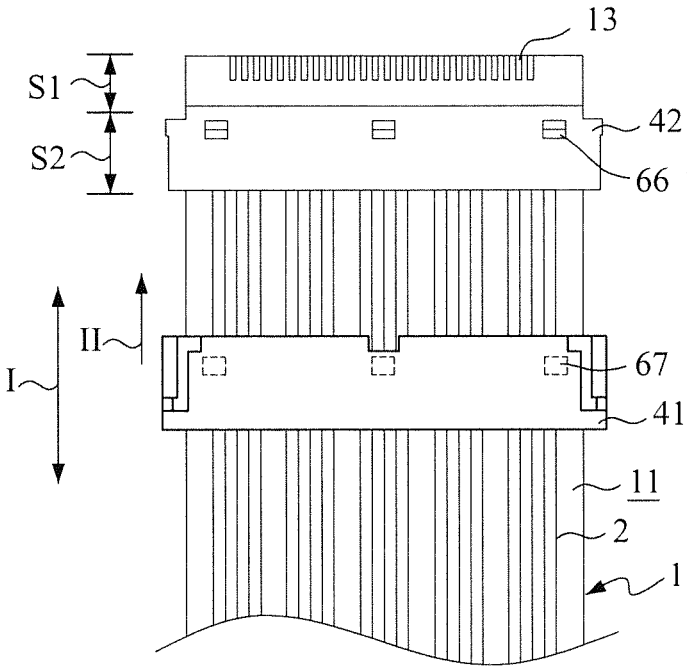
FIG. 14 is a schematic view illustrating an alternative way that the plastic member forms the locking section and the metal member forms the counterpart locking section according to the third embodiment of the present invention.

Furthermore, besides being formed on a side edge of the plastic member 42, the locking section 66 may alternatively formed on a top of the plate body of the plastic member 42 (see FIG. 14), and the counterpart locking section 67 of the metal member 41 is formed on a bottom of a plate portion of the metal member 41 at a location corresponding to the locking section 66.

Figure 15:
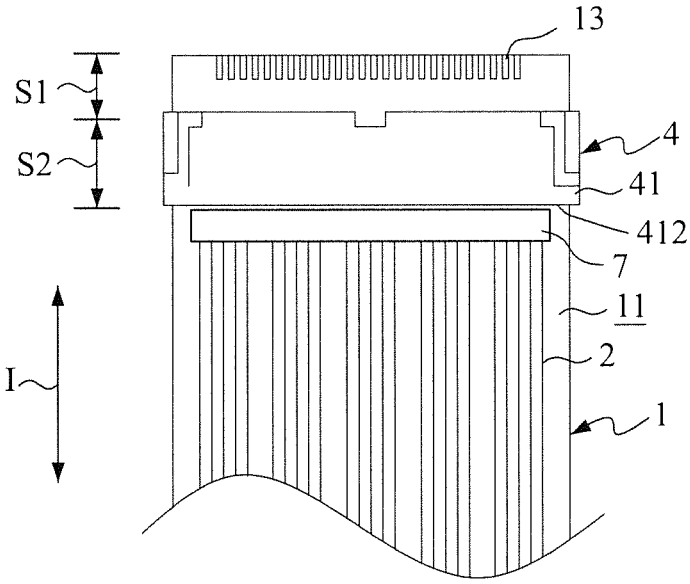
FIG. 15 is a schematic view illustrating a fourth embodiment of the present invention.

Referring to FIG. 15, a fourth embodiment of the present invention is schematically illustrated. In the instant embodiment, a detachment and displacement protection structure comprises at least one stop section 7, which is formed on the first surface 11 of the flexible circuit flat cable 1. When the metal member 41 of the inserter 4 is fit over and coupled to the plastic member 42, a rear end surface 412 of the metal member 41 is in contact engagement with the stop section 7 to constrain displacement of the metal member 41. The stop section 7 may be alternatively set on the second surface 12 of the flexible circuit flat cable 1. The stop section 7 is of a predetermined height and can be made of a regular insulation material.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A detachment and displacement protection structure of a flexible circuit flat cable, said detachment and displacement protection structure comprises:

at least one projecting lug section formed on a side edge of the flexible circuit flat cable;

a retention section formed on a plastic member of an inserter at a location corresponding to the projecting lug section of the flexible circuit flat cable;

at least one recess formed in a side edge of the flexible circuit flat cable; and a retention slot formed in the plastic member of the inserter at a location corresponding to the recess of the flexible circuit flat cable;

whereby when the plastic member is mounted to an inserter positioning section of the flexible circuit flat cable, the retention section of the plastic member of the inserter engages the projecting lug section of the flexible circuit flat cable; and the retention slot of the plastic member of the inserter engages the recess of the flexible circuit flat cable;

wherein the flexible circuit flat cable has a first surface and a second surface, the flexible circuit flat cable extends in a flat cable extension direction to form a free end having an insertion section and the inserter positioning section in an area adjacent to the insertion section;

wherein a plurality of conductive traces are formed on a flexible substrate, the conductive traces extend through the inserter positioning section to reach the insertion section of the flexible circuit flat cable and form a plurality of the conductive terminals in the insertion section;

wherein an insulation cover layer is formed on the conductive traces as the first surface; and wherein the inserter is positioned on the inserter positioning section, the inserter has a metal member and the plastic member, so that in assembling, the plastic member is first positioned on the first surface of the inserter positioning section of the flexible circuit flat cable and then the metal member is fit over the plastic member.

2. A detachment and displacement protection structure of a flexible circuit flat cable, said detachment and displacement protection structure comprises:

at least one projecting lug section projecting from a side edge of the flexible circuit flat cable within an inserter positioning section;

at least one projecting wing section projecting from a side edge of the flexible circuit flat cable, the projecting wing section being arranged adjacent to the projecting lug section with a predetermined distance formed therebetween; and a retention section formed on a plastic member of an inserter at a location corresponding to the projecting lug section of the flexible circuit flat cable;

whereby when the plastic member is mounted to the inserter positioning section of the flexible circuit flat cable, the retention section of the plastic member of the inserter engages the projecting lug section of the flexible circuit flat cable and when a metal member is fit over and coupled to the plastic member, a rear edge surface of the metal member is in engagement with the projecting wing sections;

wherein the flexible circuit flat cable has a first surface and a second surface, the flexible circuit flat cable extends in a flat cable extension direction to form a free end having an insertion section and the inserter positioning section in an area adjacent to the insertion section;

wherein a plurality of conductive traces are formed on a flexible substrate, the conductive traces extend through the inserter positioning section to reach the insertion section of the flexible circuit flat cable and form a plurality of the conductive terminals in the insertion section;

wherein an insulation cover layer is formed on the conductive traces as the first surface; and wherein the inserter is positioned on the inserter positioning section, the inserter has the metal member and the plastic member, so that in assembling, the plastic member is first positioned on the first surface of the inserter positioning section of the flexible circuit flat cable and then the metal member is fit over the plastic member.

* * * * *